US005316313A

United States Patent [19]

Moore

[11] Patent Number: 5,316,313

[45] Date of Patent: May 31, 1994

[54] FRANGIBLE BIODEGRADABLE CLAY TARGET

[76] Inventor: Patrick T. Moore, 24204 Dahgo Dr., Santa Clarita, Calif. 91355-1915

[21] Appl. No.: 164,037

[22] Filed: Dec. 9, 1993

[51] Int. Cl.[5] ..... F41J 9/16

[52] U.S. Cl. ..... 273/363

[58] Field of Search ..... 273/362, 363, 364, 365, 273/380

[56] References Cited

U.S. PATENT DOCUMENTS

| | | | |
|---|---|---|---|
| D. 17,419 | 6/1987 | Cruttenden et al. | 273/362 X |
| 222,301 | 12/1879 | Newbold | 273/362 |
| 292,118 | 6/1884 | Jopling | 273/362 |
| 2,650,829 | 9/1953 | Jordan | 273/362 |
| 2,653,026 | 9/1953 | Feltus | 273/362 |
| 3,767,440 | 10/1973 | Olix | 106/214 |
| 4,124,550 | 11/1978 | Kobayashi et al. | 260/23.3 |
| 4,568,087 | 2/1986 | Schreiner-Hansen | 273/362 |
| 4,623,150 | 11/1986 | Moehlman et al. | 273/362 |
| 4,801,150 | 1/1989 | Stevenson | 273/362 |
| 5,174,581 | 12/1992 | Goodson | 273/363 |

FOREIGN PATENT DOCUMENTS

| | | | |
|---|---|---|---|
| 637967 | 10/1993 | Australia | 273/362 |
| 487381 | 5/1992 | European Pat. Off. | 273/362 |
| 23943 | 9/1883 | Fed. Rep. of Germany | 273/362 |
| 146687 | 12/1903 | Fed. Rep. of Germany | 273/362 |
| 657812 | 3/1938 | Fed. Rep. of Germany | 273/362 |

*Primary Examiner*—William H. Grieb
*Attorney, Agent, or Firm*—Donald E. Nist

[57] ABSTRACT

The present clay target is inverted cup-shaped with a central dome and depending annular rim. The central portion of the dome may be horizontal and preferably bears a plurality of plant seeds and plant fertilizer pellets embedded therein to improve the environment. The target is of clay containing up to about 2 weight % of biodegradable binder which is sodium silicate with or without dextrin. The target is a greenware body which is dried to a low water content of less than about 2 weight % but is unfired. It is thin enough to be frangible and fragments into small pieces when hit by a shotgun pellet. For this purpose, a preferred embodiment includes spaced radiating grooves in the upper and lower surfaces of the dome, preferably offset from one another, and a number of moon-shaped depressions in the inner surface of the rim. The outer surface of the dome may also include spaced concentric grooves in the dome which intersect the radiating grooves and further facilitate target fragmenting when hit by a shotgun pellet.

13 Claims, 2 Drawing Sheets

FRANGIBLE BIODEGRADABLE CLAY TARGET

BACKGROUND OF THE INVENTION

1. Field of the Invention

The present invention generally relates to the shooting sports and more particularly to an improved readily frangible biodegradable clay target for the same.

2. Prior Art

Conventional clay targets which are thrown into the air from hand launchers or machine launchers in skeet shooting, in trap shooting and in practicing for field shooting of birds include non-biodegradable components, for example, pitches, tars and other petroleum products generally used as binders for limestone-containing targets. Such binders are noxious and dangerous but are needed to strengthen the targets sufficiently so they can be stored, shipped and launched without prematurely breaking. Such noxious substances may penetrate the soil and adversely affect wildlife, plant life, underground water supplies and the like. Certain of such clay targets are fired into ceramic in order to increase their strength, but such ceramic targets are in and of themselves a hazard to the environment, since they do not readily biodegrade but lie on the ground, preventing plant growth and remaining an unsightly mess.

Because clay target shooting sports are very popular, many thousands of the targets are exploded over the landscape during the course of a season of shooting at numerous shooting grounds. Accordingly, there is a need to provide an improved form of clay target which is biodegradable and, preferably bio-improveable, and which is inexpensive and aerodynamically sound.

Moreover, it should be sufficiently frangible so that it readily breaks into small fragments when hit by a shotgun pellet, in contrast to certain conventional clay and other targets which tend to deflect but not to explode or minutely fragment when hit during shooting. It is important to the shooter to be able to register a hit by the exploding target, rather than guess at a hit by a deflected but unexploded target.

SUMMARY OF THE INVENTION

The improved clay target of the present invention satisfies all the foregoing needs. The target is substantially as set forth in the ABSTRACT OF THE DISCLOSURE.

Thus, the target is characterized, in part, by its compositon which is clay plus up to about 2 percent by weight of sodium silicate binder, with or without dextrin. The dextrin, when present, is in a concentration which does not exceed about 1 weight percent. When both the sodium silicate and the dextrin are present in the target, their combined concentration, which is the total concentration of binder in the target, does not exceed 2 weight percent. The target may also includes a small concentration of water, e.g. about 2 weight percent which remains in the finished greenware unfired product after hot pressing the composition to form the target.

The target is in the shape of an inverted cup with central dome and depending annular rim. The dome includes in its outer and inner surfaces sets of spaced radiating grooves. The sets are offset from each other, each groove extending up to about 40–80% of the depth or thickness of the dome. The grooves help to break up the target into small fragments when it is hit during shooting. This is further faciliated by the presence of a series of depressions, preferably half-moon shaped, on the inner surface of the rim and aligned with the inner set of grooves. Additional concentric grooves preferably are present in the outer surface of the dome to facilitate further fragmentation of the target.

In one embodiment the dome has a central horizontal portion in which are embedded a plurality of plant seeds and plant fertilizer pellets to enhance the environment. Because the target is greenware and readily fragments into small pieces when hit by one or more shotgun pellets, it is readily absorbed into the soil without injuring the environment, but in fact improving it, since it promotes the support of game birds and the growth of plant life.

The thickness of the target is controlled to facilitate the desired fragmentation. In most instances, the target is about 0.1–0.2 inch in thickness. The dome may be about 0.1–0.15 inch thick, with the grooves being e.g. about 0.05 inch deep. The rim may be about 0.2 inch in thickness with the depressions about 0.1 inch deep. Other suitable parameters may be used.

The target is simple, easy to make, store, ship and launch and is inexpensive, environmentally safe and capable of improving the environment. Further features of the invention are set forth in the following detailed description and accompanying drawings.

DRAWINGS

DETAILED DESCRIPTION

FIGS. 1–3

Figure 1:
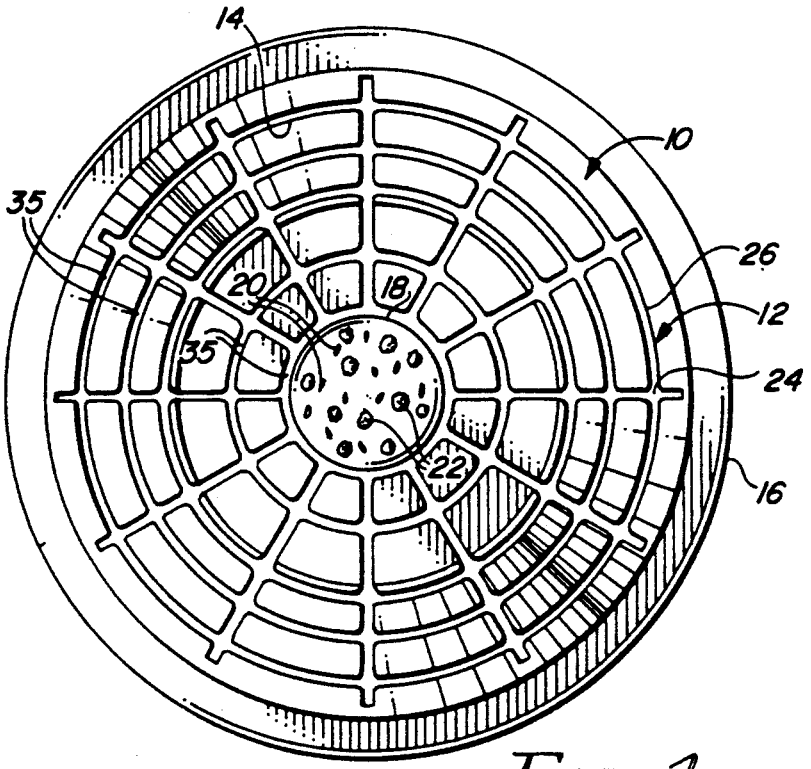
FIG. 1 is a schematic top plan view of a first preferred embodiment of the improved clay target of the present invention.
Figure 2:
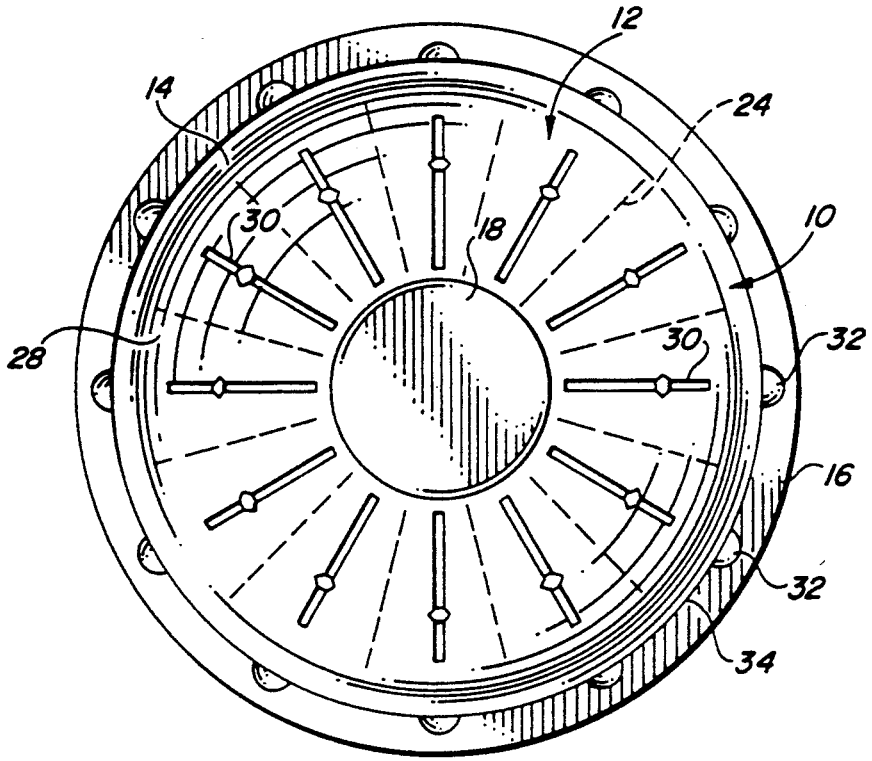
FIG. 2 is a schematic bottom plan view of the clay target of FIG. 1, with the exterior grooves of the target shown in dotted outline.
Figure 3:
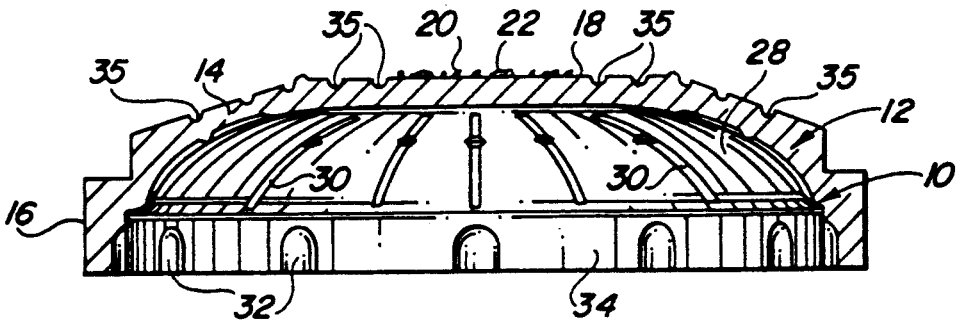
FIG. 3 is a schematic vertical cross-section of the clay target of FIG. 1; and, FIG. 4 is a schematic top plan view of a second preferred embodiment of the improved clay target of the present invention, with the grooves in the inner surface of the dome thereof and the depressions in the inner surface of the rim thereof being shown in dotted outline.
Figure 4:
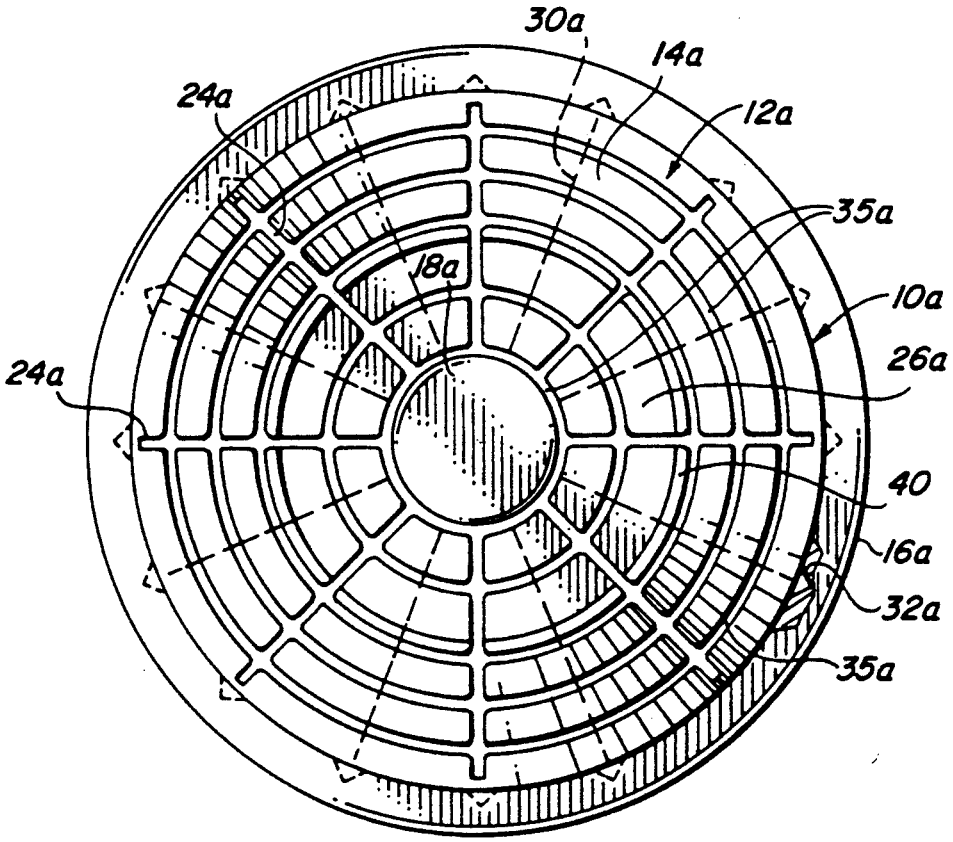

Now referring more particularly to FIGS. 1–3 of the drawings, a first preferred embodiment of the improved clay target of the present invention is schematically depicted therein.

Thus, clay target 10 is shown which comprises a target body 12 in the form of an inverted cup, having a central curved dome 14 and integral annular depending rim 16. The central portion 18 of dome 14 is horizontal and includes a plurality of plant seeds 20 and plant fertilizer pellets 22 embedded therein, in order to promote the feeding of game birds and the growth of ground cover.

Clay target 10 is a greenware product which has been dried to a low water content but which has not been fired and therefore is not ceramic. Target 10 has the following composition: a binder in the form of sodium silicate, with or without dextrin, in a concentration of about 1–2 percent by weight of the target; clay; and, a low concentration of water or moisture, usually well below 2 percent by weight. No enivronmentally harmful substances are present. The seeds and fertilizer pellets, when present, are in a very low concentration, usually less than about 1 weight percent. When the dextrin is present, its concentration is not above about 1 weight percent, with the sodium silicate constituting the remainder of the binder.

Any suitable conventional clay normally employed as the inert ingredient in clay targets can be used in the present target. Clays are by definition small particle size hydrous aluminum silicates which exhibit plasticity when wet. They are naturally found in certain earth deposits and have no deleterious effects on the environment. They include components such as kaolinite, halloysite and montmorillonite. Their particle size is generally less than about 0.00016 inch.

Sodium silicate, also known as water glass, is available commercially as green lumps and as powders, as well as aqueous solutions. It has strong binding properties and is environmentally safe. Dextrin is also known as starch gum and is an intermediate product formed by the hydrolysis of starch. It is a carbohydrate which is environmentally safe and has binding properties. It is commercially available.

The clay target 10 is formed by first mixing together the above-indicated components in the indicated concentrations, except that sufficient additional water is present, up to about a total of about 10 weight percent, in order to form the composition into a moldable paste.

In one procedure, the mixing is followed by sieving to remove lumps and to assure full blending, after which the mixture is allowed to stand long enough (1–24 hours) to assure full absorption of the water. Thereupon, the mixture is formed into small balls, e.g. up to about 0.125 inch in diameter, and the balls are charged into a press and molded therein at a temperature below a ceramic-forming firing temperature into the finished dried greenware product. Typical heating temperature in the press is about 300°–400 ° F. Firing temperatures are avoided.

In another typical procedure the same mixture as indicated above is thoroughly blended into a smooth blend in a conventional V-cone blender over a period of about 5–10 minutes, with addition of the water and sodium silicate slowly to the clay during the mixing operation. Sieving is obviated because the blend is free of lumps. The blend can then be immediatlely poured into the press and hot molded therein, or can first be formed into the small balls, as in the prior procedure. Allowing the blend to stand to wait for full water absorption is unnecessary, because the blending in the V-cone blender is complete.

During the molding operation in the press, a first set of spaced radiating grooves 24 can be molded by a suitably configured mold (not shown) into the outer surface 26 of dome 14 and into the inner surface 28 thereof a second set of radiating spaced grooves 30 can be molded, with grooves 24 being offset from grooves 30 so as not to unnecessarily weaken target 10. Grooves 24 and 30 permit target 10 to readily fragment into small pieces when hit by one or more shotgun pellets. Preferably, spaced half moon-shaped depressions 32 are molded into the inner surface 34 of rim 16, depressions 32 being aligned preferably with grooves 30 ( FIG. 2). Four concentric grooves 35 are in surface 26 of dome 14 to further facilitate fragmentation of target 10.

During the molding operation, that is, the hot pressing, the thickness of target body 12 is carefully controlled, due to the configuration of the mold used, so that the average thickness of dome 14 is usually about 0.1–0.15 inch, the average depth of grooves 24 and 30 is usually about 40–80% of the dome thickness, rim 16 is usually about 0.2 inch thick and depressions 32 are usually about 0.1 inch thick. With this configuration, target 10 remains durable enough for shipment, storage and use, but readily fragments when hit by a shotgun pellet, with both rim 16 and dome 14 disintegrating into small pieces readily absorbed by the soil.

It will be understood that the thickness of dome 14 and rim 16 and the depth of grooves 24 and 30 and depressions 32 will depend on the uses to which target 10 is to be put, its overall dimensions, etc. One form of target 10 is 4.25 inches in diameter and 1.125 inches high. A second typical target 10 can be of smaller size, for example, with a diameter of about 2.375 inches and a height of about 0.8125 inch. Alternatively, target 10 can be of larger size and somewhat different relative dimensions.

Target 10 is simple, effective, inexpensive to make and use and environmentally safe. Moreover, it enriches the environment by adding plant seeds and fertilizer to the soil. It represents a substantial improvement over conventional targets.

FIG. 4

A second preferred embodiment of the improved clay target of the present invention is schematically depicted in FIG. 3. Thus, target **10*a* is shown. Components thereof similar to those of target 10** bear the same numerals but are succeeded by the letter "a".

Target **10*a* differs from target 10** only as follows:

a) target **10*a*** contains no plants seeds or fertilzer pellets;

b) depressions **32*a* are v-shaped in plan view rather than half-moon shaped and are aligned with both sets of radiating grooves 24*a* and 30*a*;**

c) there are eight radiating grooves **24*a* instead of twelve, as in target 10, and eight radiating grooves 30*a* instead of twelve; moreover, the placement of grooves 24*a* and 30*a* is not totally symmetrical; and, d) dome 14*a* contains a concentric circumferential upraised ridge 40, which also may or may not be present in target 10**.

Target **10*a* functions similarly to target 10 and has the advantages of target 10**, except for not enhancing the environment with plant seed and fertilizer.

Various other modifications, alterations, changes and additions can be made in the improved target of the present invention, its components, its composition and parameters. All such modifications, changes, alterations and additions as are within the scope of the appended claims form part of the present invention.

What is claimed is:

1. An improved, biodegradable, frangible clay target for sport shooting, said target comprising an unfired dried greenware target body capable of being thrown into the air to function as a moving target but readily fragmenting when struck by a shotgun pellet, said body comprising up to about 2 percent, by weight of said body, of a biodegradable binder, said binder comprising sodium silicate, with substantially the remainder of said target comprising clay and a low concentration of water.

2. The improved clay target of claim 1 wherein said binder is present in said target body in a concentration of about 1–2 percent by weight of said body.

3. The improved clay target of claim 2 wherein said sodium silicate is in a concentration of about 1–2 weight percent of said body and wherein said binder includes dextrin in a concentration of about 0–1 weight percent of said body, the total concentration of said binder not exceeding 2 weight percent of said body.

4. The improved clay target of claim 3 wherein said target includes up to about 2 percent of water, by weight of said body.

5. The improved clay target of claim 3 wherein said target body is in the shape of an inverted cup with inner and outer surfaces in the form of a domed central portion and a depending annular rim, and wherein said target body includes a first set of spaced radiating grooves in the domed portion of the outer surface thereof and a corresponding second set of spaced radiating grooves in the domed portion of the inner surface thereof, said second set being offset with respect to said first set, said sets facilitating ready fragmentation of said target when hit during target shooting.

6. The improved clay target of claim 5 wherein said target body also includes a spaced plurality of depressions in said rim which further facilitate said fragmenting.

7. The improved clay target of claim 6 wherein said depressions are in the inner surface of said rim and aligned with said second set of grooves and wherein said depressions are half-moon shaped.

8. The improved clay target of claim 6 wherein said domed portion contains in the outer surface thereof a plurality of concentric grooves which intersect said first set of radiating grooves.

9. The improved clay target of claim 6 wherein said depressions are in the inner surface of said rim and aligned with both sets of radiiating grooves.

10. The improved clay target of claim 7 wherein said dome and rim have an average thickness of about 0.1–0.2 inch and wherein said grooves have an average depth of about 0.05 inch.

11. The improved clay target of claim 10 wherein said rim has a thickness of about 0.2 inch and wherein said depressions have an average depth of about 0.1 inch in said rim.

12. The improved clay target of claim 1 wherein said target body includes a spaced plurality of plant seeds and pellets of plant fertilizer embedded therein to improve the environment.

13. The improved clay target of claim 5 wherein said dome has a horizontal central portion which bears a plurality of plant seeds and plant fertilizer pellets embedded therein to improve the environment.

* * * * *